US008191749B1

(12) United States Patent
Edwards-Delgado et al.

(10) Patent No.: US 8,191,749 B1
(45) Date of Patent: Jun. 5, 2012

(54) OBJECT HOLDING SYSTEM

(76) Inventors: Linda Edwards-Delgado, Clearwater Beach, FL (US); Tabitha Eiseman, Clearwater Beach, FL (US)

( * ) Notice: Subject to any disclaimer, the term of this patent is extended or adjusted under 35 U.S.C. 154(b) by 601 days.

(21) Appl. No.: 12/228,040

(22) Filed: Aug. 8, 2008

Related U.S. Application Data

(63) Continuation-in-part of application No. 11/974,053, filed on Oct. 11, 2007, now Pat. No. 7,690,543.

(51) Int. Cl.
*A45F 5/00* (2006.01)

(52) U.S. Cl. ..... 224/680; 224/660; 224/674; 224/676; 224/677; 224/683

(58) Field of Classification Search ..... 224/660, 224/662, 663, 665, 672, 673, 676, 677, 680, 224/682, 684, 674, 683
See application file for complete search history.

(56) References Cited

U.S. PATENT DOCUMENTS

| | | | | | |
|---|---|---|---|---|---|
| 1,482,130 | A * | 1/1924 | Griest | | 224/576 |
| 2,474,495 | A * | 6/1949 | Pollak | | 224/245 |
| 3,212,690 | A * | 10/1965 | Green | | 224/576 |
| 4,072,256 | A | 2/1978 | Young | | |
| 4,706,860 | A | 11/1987 | Leider | | |
| 4,836,427 | A | 6/1989 | McManus | | |
| 5,064,107 | A | 11/1991 | Ascarrunz | | |
| 5,289,960 | A * | 3/1994 | Kelly et al. | | 224/664 |
| D355,070 | S | 2/1995 | Thiessen | | |
| 5,465,888 | A | 11/1995 | Owens | | |
| 5,730,340 | A | 3/1998 | Bosic | | |
| 5,788,170 | A * | 8/1998 | Hester | | 224/684 |
| 5,836,497 | A * | 11/1998 | Pelish | | 224/677 |
| 5,870,777 | A * | 2/1999 | Hans | | 2/238 |
| D411,038 | S | 6/1999 | Fair et al. | | |
| 6,216,933 | B1 * | 4/2001 | Healy | | 224/663 |
| 6,446,852 | B1 * | 9/2002 | Sorensen et al. | | 224/661 |
| 6,561,402 | B2 * | 5/2003 | Holland et al. | | 224/677 |
| 7,204,398 | B1 * | 4/2007 | Smith, Sr. | | 224/607 |
| 2002/0170933 | A1 * | 11/2002 | Martin | | 224/197 |

* cited by examiner

*Primary Examiner* — Nathan J Newhouse
*Assistant Examiner* — Steven M Landolfi, Jr.

(57) ABSTRACT

A housing assembly is constructed of a front and rear sheets. The rear sheet has a horizontal linear upper edge and a convex lower edge with curved first and second side edges. The rear sheet has an upper section with opposing side edges and a lower section with opposing convex side edges. The front sheet has a horizontal linear upper edge and a convex lower edge with curved side edges, the lower and side edges overlying and coupled to the lower and side edges of the rear sheet. The upper edge of the front sheet is parallel with and spaced below the upper edge of the rear sheet with an upper opening to define a primary pouch. A generally rectangular supplemental sheet is coupled at its side and lower edges to the front sheet to form a secondary pouch.

1 Claim, 5 Drawing Sheets

FIG 1
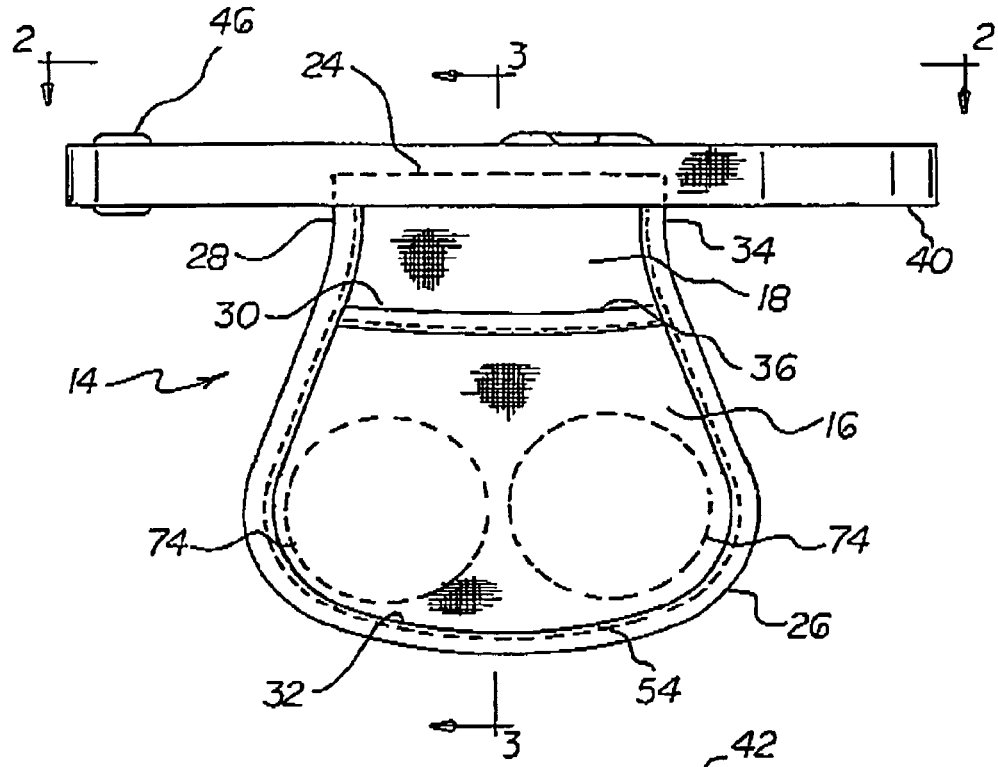
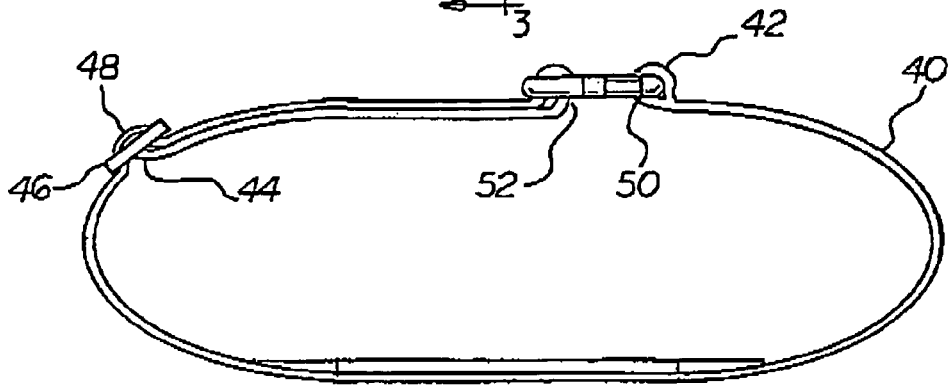
FIG 2

FIG 3
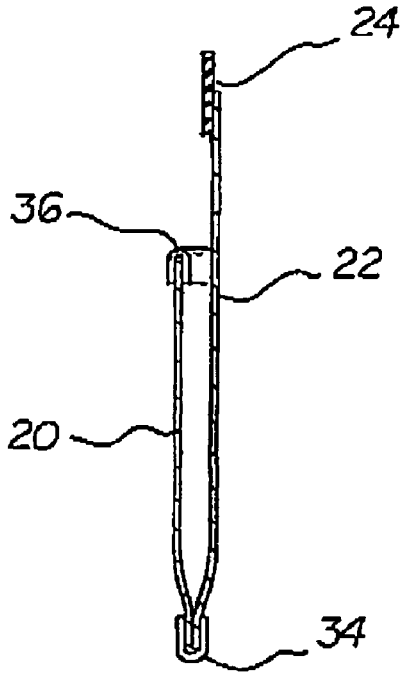
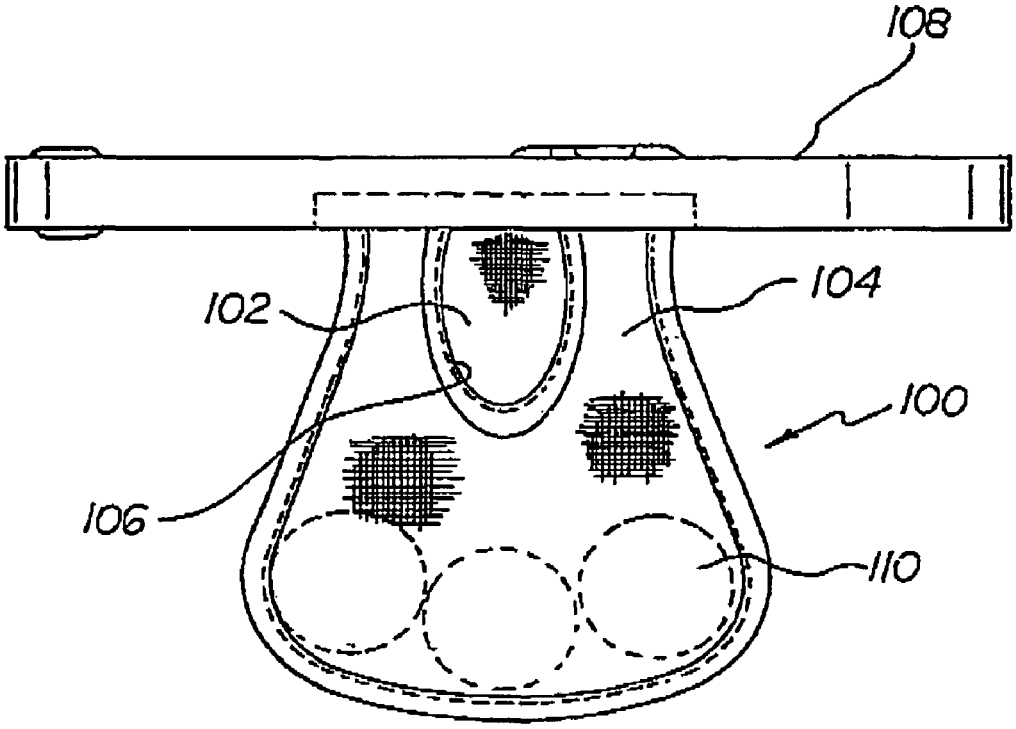
FIG 4

FIG 6
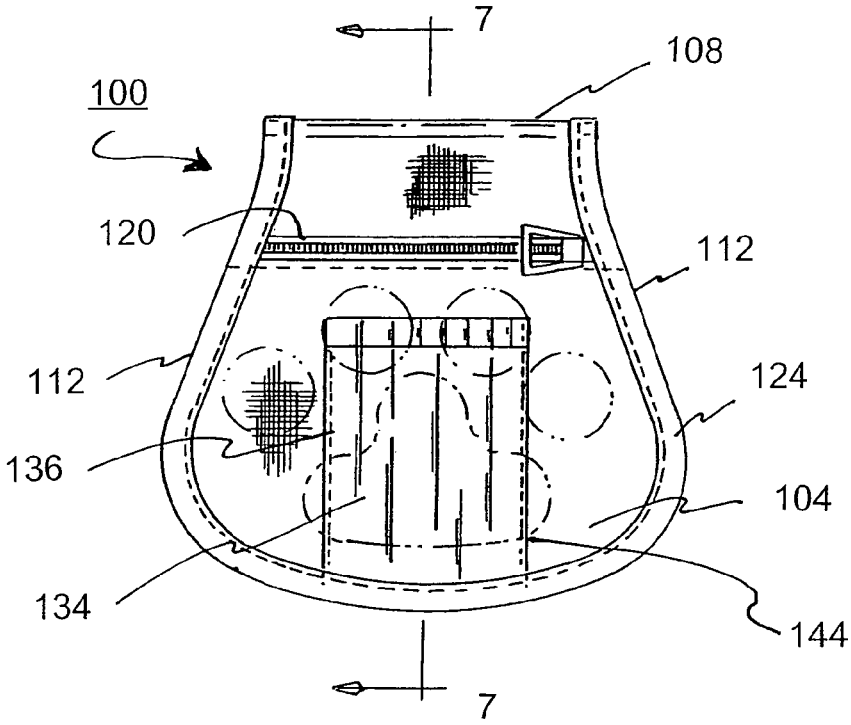
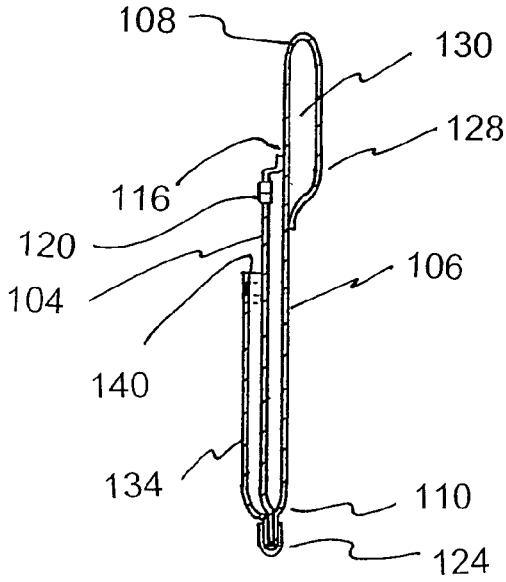
FIG 7

FIG 8
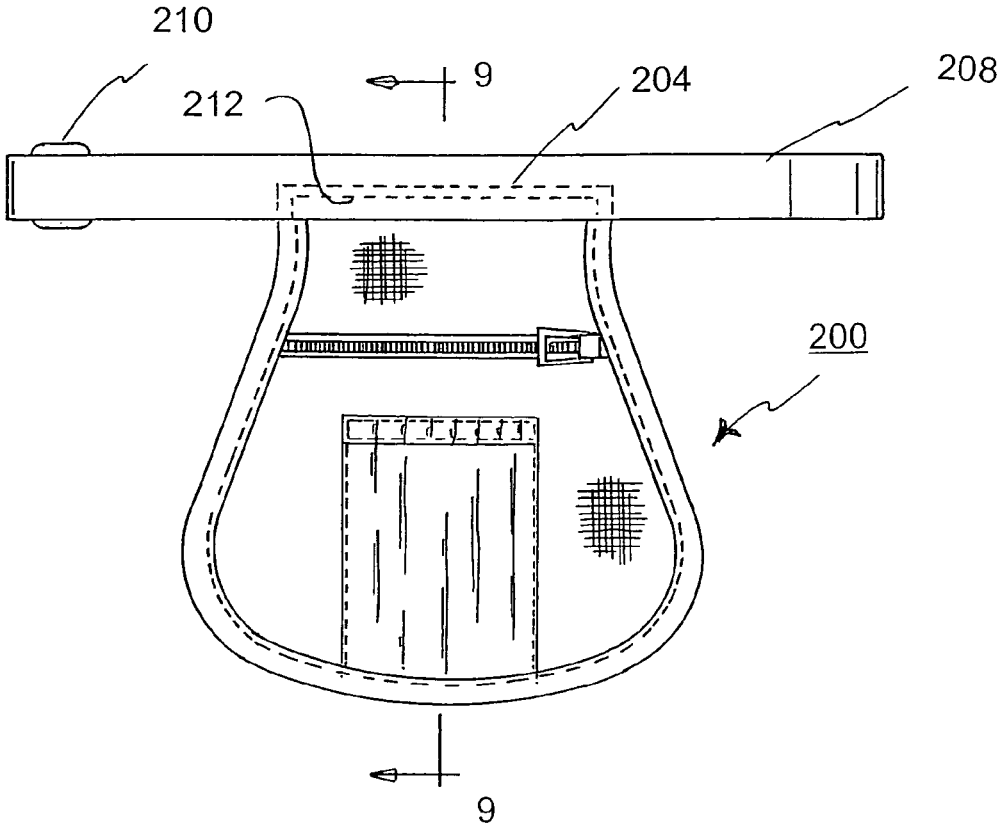
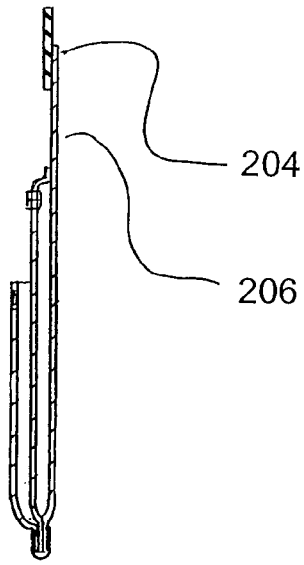
FIG 9

OBJECT HOLDING SYSTEM

RELATED APPLICATION

The present invention is a continuation-in-part of co-pending application Ser. No. 11/974,053 filed Oct. 11, 2007 now U.S. Pat. No. 7,690,543, the subject matter of which is incorporated herein by reference.

BACKGROUND OF THE INVENTION

1. Field of the Invention

The present invention relates to an object holding system and more particularly pertains to removably retaining objects in a primary pouch and a cell phone in a secondary pouch for ready use by a user in a safe, convenient, economical and attractive manner.

2. Description of the Prior Art

The use of object holding systems of known designs and configurations is known in the prior art. More specifically, object holding systems of known designs and configurations previously devised and utilized for the purpose of holding wallets, keys, cell phones and other objects through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,072,256 issued Feb. 7, 1978 to Young relates to a Game Ball Holder. U.S. Pat. No. 4,706,860 issued Nov. 17, 1987 to Leider relates to a Ball Quiver. U.S. Pat. No. 4,836,427 issued Jun. 6, 1989 to McManus relates to a Tennis Utility Belt. Lastly, U.S. Pat. No. 5,064,107 issued Nov. 12, 1991 to Ascarrunz relates to a Tennis Ball Holder. U.S. Pat. No. Des. 355,070 issued Feb. 7, 1995, to Thiessen discloses a Fanny Pack. U.S. Pat. No. Des. 411,038 issued Jun. 15, 1999, to Fair et al. discloses a Diaper Fanny Pack. U.S. Pat. No. 5,730,340 issued Mar. 24, 1998 to Bosic discloses a Fanny Pack with Child's Toy Retaining Assembly. Lastly, U.S. Pat. No. 5,465,888 issued Nov. 14, 1995 to Owens discloses a Child Care Accessory Cycling Belt.

While these devices fulfill their respective, particular objectives and requirements, the aforementioned patents do not describe an object holding system that allows for removably retaining objects in a primary pouch and a cell phone in a secondary pouch for ready use by a user in a safe, convenient, economical and attractive manner.

In this respect, the object holding system according to the present invention substantially departs from the conventional concepts and designs of the prior art, and in doing so provides an apparatus primarily developed for the purpose of removably retaining objects in a primary pouch and a cell phone in a secondary pouch for ready use by a user in a safe, convenient, economical and attractive manner.

Therefore, it can be appreciated that there exists a continuing need for a new and improved object holding system which can be used for removably retaining objects in a primary pouch and a cell phone in a secondary pouch for ready use by a user in a safe, convenient, economical and attractive manner. In this regard, the present invention substantially fulfills this need.

SUMMARY OF THE INVENTION

In view of the foregoing disadvantages inherent in the known types of object holding systems of known designs and configurations now present in the prior art, the present invention provides an improved object holding system. As such, the general purpose of the present invention, which will be described subsequently in greater detail, is to provide a new and improved object holding system and method which has all the advantages of the prior art and none of the disadvantages.

To attain this, the present invention essentially comprises an object holding and carrying system for removably retaining a wallet, keys and other objects in a primary pouch and a cell phone in a secondary pouch for ready use by a user in a safe, convenient, economical and attractive manner.

First provided is a housing assembly constructed of a front sheet and a rear sheet. The rear sheet has interior and exterior surfaces. The rear sheet has a horizontal linear upper edge and a convex lower edge separated by a maximum height of between 7.5 inches and 8.5 inches. The rear sheet has curved first and second side edges separated by a maximum width below of between 7.25 inches and 8.0 inches and a minimum width above of between 5.25 inches and 6.25 inches. The rear sheet has an upper section with opposing concave side edges and a lower section with opposing convex side edges.

The front sheet has interior and exterior surfaces. The interior surface of the front sheet faces the exterior surface of the rear sheet. The front sheet has a horizontal linear upper edge and a convex lower edge and curves side edges. The lower and side edges of the front sheet overly the lower and side edges of the rear sheet. The upper edge of the front sheet is parallel with and spaced below the upper edge of the rear sheet by between 1.5 and 2.5 inches. In this manner, a primary pouch is defined for the retrievable storage of a wallet and keys and other like personal objects.

Next provided is a zipper. The zipper extends across the front sheet parallel with and in close proximity to the upper edge of the front sheet for opening and closing access to the primary pouch.

Next provided is a binding. The binding has stitching extending from one end of the upper edge of the rear sheet along the first side edge and the lower edge and the second side edge and terminating at another end of the upper edge of the rear panel to couple the front and rear sheets.

Next provided is a rear sheet extension adjacent to the upper edge of the rear sheet. The extension is formed by the rear sheet adjacent to its upper edge being folded back and attached to the interior surface of the rear sheet in proximity to the zipper. In this manner a tunnel is formed for the removable receipt of a belt to couple the system to a user.

Next provided is a supplemental sheet. The supplemental sheet has interior and exterior surfaces. The interior surface faces the exterior surface of the front sheet. The supplemental sheet is in a generally rectangular configuration. Parallel upper and lower edges of the supplemental sheet form a height of between 3.75 inches and 4.25 inches and parallel side edges form a width of between 3.0 inches and 3.75 inches. The upper edge is parallel with and spaced beneath the zipper. The lower edge overlies the lower edge of the front sheet beneath the binding. The stitching of the binding joins the supplemental sheet to the front sheet at their lower edges. Supplemental stitching is provided between the upper and lower edges of the supplemental sheet thereby forming a secondary pouch for the removable retention of a cell phone.

Next provided is an elastic band. The elastic band is coupled to the upper edge of the supplemental sheet. The elastic band is of a length when not stretched less than the length of the upper edge of the supplemental sheet. In this manner shirring of the upper edge of the supplemental sheet is caused for facilitating the retention of a cell phone within the secondary pouch.

Lastly, all of the sheets are fabricated of an inelastic material. Indicia is provided on the exterior surface of the front sheet and supplemental sheet.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved object holding system which has all of the advantages of the prior art object holding systems of known designs and configurations and none of the disadvantages.

It is another object of the present invention to provide a new and improved object holding system which may be easily and efficiently manufactured and marketed.

It is further object of the present invention to provide a new and improved object holding system which is of durable and reliable constructions.

An even further object of the present invention is to provide a new and improved object holding system which is susceptible of a low cost of manufacture with regard to both materials and labor, and which accordingly is then susceptible of low prices of sale to the consuming public, thereby making such object holding system economically available to the buying public.

Even still another object of the present invention is to provide an object holding system for removably retaining objects in a primary pouch and a cell phone in a secondary pouch for ready use by a user in a safe, convenient, economical and attractive manner.

Lastly, it is an object of the present invention to provide an object holding system having a housing assembly constructed of front and rear sheets. The rear sheet has a horizontal linear upper edge and a convex lower edge with curved first and second side edges. The rear sheet has an upper section with opposing side edges and a lower section with opposing convex side edges. The front sheet has a horizontal linear upper edge and a convex lower edge with curved side edges, the lower and side edges overlying and coupled to the lower and side edges of the rear sheet. The upper edge of the front sheet is parallel with and spaced below the upper edge of the rear sheet with an upper opening to define a primary pouch. A generally rectangular supplemental sheet is coupled at its side and lower edges to the front sheet to form a secondary pouch.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a tennis ball holder constructed in accordance with the principles of the present invention.

FIG. 2 is a plan view of the tennis ball holder taken at line 2-2 of FIG. 1.

FIG. 3 is a cross sectional view of the tennis ball holder taken at line 3-3 of FIG. 1.

FIG. 4 is a front elevational view of a tennis ball holder constructed in accordance with an alternate embodiment of the present invention.

FIG. 6 is a front elevational view of an object holder system constructed in accordance with the alternate embodiment of the invention.

FIG. 7 is a cross sectional view taken through line 7-7 of FIG. 6.

FIG. 8 is a front elevational view of another alternate embodiment of the invention.

FIG. 9 is a cross sectional view taken along line 9-9 of FIG. 8.

The same reference numerals refer to the same parts throughout the various Figures.

DESCRIPTION OF THE PREFERRED EMBODIMENT

Figure 5:
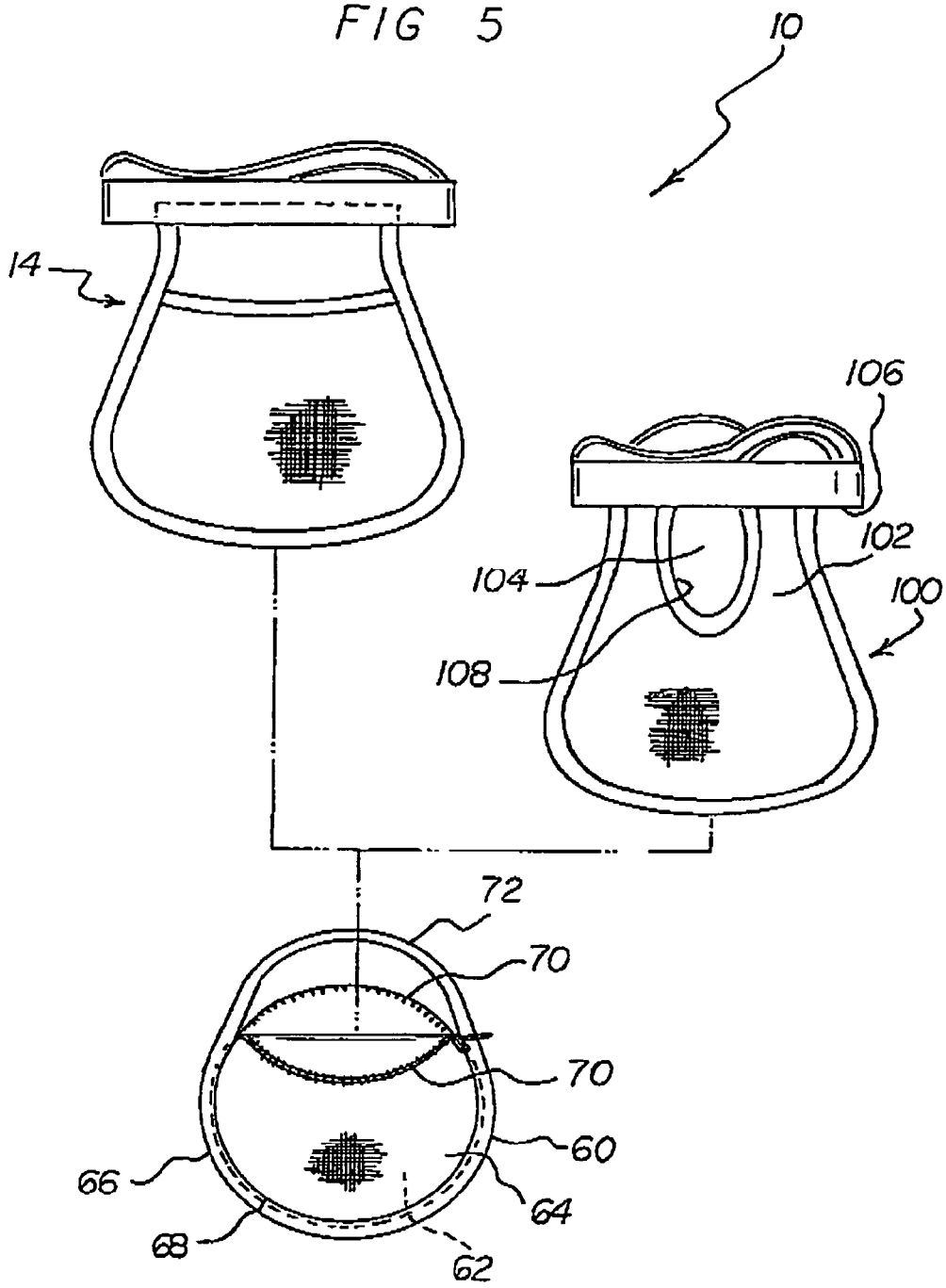
FIG. 5 as an exploded front elevational view of a tennis ball holder system constructed in accordance with the principles of the present invention.

With reference now to the drawings, and in particular to FIG. 1 thereof, the preferred embodiment of the new and improved tennis ball holder embodying the principles and concepts of the present invention and generally designated by the reference numeral 10 will be described.

The present invention, the tennis ball holder 10 is comprised of a plurality of components. Such components in their broadest context include a housing assembly and a waste band. Such components are individually configured and correlated with respect to each other so as to attain the desired objective.

First provided is a housing assembly 14. The housing assembly has a lower extent 16. The housing assembly has an upper extent 18. The housing assembly has a maximum height of about 8.25 inches. The housing assembly has a maximum width of about 7.25 inches at a central elevational of the lower extent. The housing assembly has a front sheet 20. The housing assembly has a rear sheet 22. The rear sheet has a linear upper edge 24. The linear upper edge has a length of about 5 inches. The linear upper edge has ends. A curved convex periphery 26 is provided for the majority of the lower extent. A curved concave periphery 28 is provided for the majority of the upper extent between the periphery of the lower extent and the upper edge. The front sheet has an arcuate upper edge 30. The arcuate upper edge has a length of about 7.5 inches. The arcuate upper edge has ends intermediate the upper and lower extents. In this manner a passageway is formed. The front sheet also has a curved convex periphery 32 for the entire lower extent. The curved convex periphery of the lower extent overlies the curved convex periphery of the rear sheet. A major binding 34 is provided. The major binding extends from one end of the upper edge of the upper extent along the peripheries of the upper and lower extents to the other end of the upper edge of the upper extent. A minor binding 36 is provided. The minor binding extends from one end of the upper edge of the lower extent to the other end of the upper edge of the lower extent.

A waste band 40 is provided next. The waste band has a first end 42. The waste band has a second end 44. The waste band has an intermediate extent. The intermediate extent is provided between the first and second ends. The waste band has a slider 46. The slider is attached to the second end and the intermediate extent. In this manner a loop 48 is formed. Further in this manner the length of the waste band is allowed to vary. The waste band has a clasp. The clasp has a first component 50. The first component is attached to the first end. The clasp has a separable second component 52. The separable second component is slidably attached to the loop. The waste band has stitching 54. The stitching secures the upper edge of the housing assembly to the intermediate extent of the band. The waste band has additional stitching 56. The additional stitching secures the binding of the housing assembly.

Further provided is a carrying case 60. The carrying case is adapted to carry the housing assembly. The carrying case has a circular front sheet 62. The carrying case has a similarly configured rear sheet 64. The carrying case has a binding 66. The carrying case has stitching 68. The stitching couples the majority of the peripheries of the front and rear sheets of the carrying case, a zipper 70 separably coupling the minority of the peripheries of the front and rear sheets of the carrying case. The carrying case has a carrying strap 72. The carrying strap is provided above the zipper. The carrying strap is formed as an extension of the binding of the carrying case. The sheets of the housing assembly and the carrying case are fabricated of Ultrawick. Ultrawick is a synthetic fabric. Ultrawick has hydrophilic wicking properties. Ultrawick also has soil release properties. Ultrawick further has an antimicrobial finish. Ultrawick is a trademark of Game Time Performance Fabrics.

Provided last are two tennis balls 74. The tennis balls are removably positioned within the housing assembly. The tennis balls are adapted to be removed through the passageway. Additional tennis balls are adapted to be introduced into the housing assembly through the passageway.

Reference is now made to the alternate embodiment of the invention illustrated in FIG. 4. A rear sheet 102 is provided. The rear sheet has upper and lower extents. The rear sheet has a linear upper edge. The rear sheet has a periphery. A front sheet 104 is provided. The front sheet has a discontinuous upper edge. A central portion extends downwardly a distance less than half the vertical height of the housing assembly in a U-shaped configuration. In this manner a passageway 106 is formed. A waste band 108 is provided. The waste band has a central extent. The waste band has stitching. The stitching couples the upper edges of the front and rear sheets to the waste band. Further included is a plurality of balls. The balls are provided within the housing assembly.

Another alternate embodiment of the present invention, an object holding and carrying system 100, is illustrated in FIGS. 6 and 7. The object holding and carrying system 100 of this alternate embodiment is for removably retaining a wallet, keys and other objects in a primary pouch and a cell phone in a secondary pouch for ready use by a user in a safe, convenient, economical and attractive manner.

First provided in this alternate embodiment is a housing assembly constructed of a front sheet 104 and a rear sheet 106. The rear sheet has interior and exterior surfaces. The rear sheet has a horizontal linear upper edge 108 and a convex lower edge 110 separated by a maximum height of between 7.5 inches and 8.5 inches. The rear sheet has curved first and second side edges 112 separated by a maximum width below of between 7.25 inches and 8.0 inches and a minimum width above of between 5.25 inches and 6.25 inches. The rear sheet has an upper section with opposing concave side edges and a lower section with opposing convex side edges.

Further in this embodiment, the front sheet has interior and exterior surfaces. The interior surface of the front sheet faces the exterior surface of the rear sheet. The front sheet has a horizontal linear upper edge 116 and a convex lower edge and curves side edges. The lower and side edges of the front sheet overly the lower and side edges of the rear sheet. The upper edge of the front sheet is parallel with and spaced below the upper edge of the rear sheet by between 1.5 and 2.5 inches. In this manner, a primary pouch is defined for the retrievable storage of a wallet and keys and other like personal objects.

Further provided in this embodiment is a zipper 120. The zipper extends across the front sheet parallel with and in close proximity to the upper edge of the front sheet for opening and closing access to the primary pouch.

Further provided in this embodiment is a binding 124. The binding has stitching extending from one end of the upper edge of the rear sheet along the first side edge and the lower edge and the second side edge and terminating at another end of the upper edge of the rear panel to couple the front and rear sheets.

Further provided in this embodiment is a rear sheet extension 128 adjacent to the upper edge of the rear sheet. The extension is formed by the rear sheet adjacent to its upper edge being folded back and attached to the interior surface of the rear sheet in proximity to the zipper. In this manner a tunnel 130 is formed for the removable receipt of a belt to couple the system to a user.

Further provided in this embodiment is a supplemental sheet 134. The supplemental sheet has interior and exterior surfaces. The interior surface faces the exterior surface of the front sheet. The supplemental sheet is in a generally rectangular configuration. Parallel upper and lower edges of the supplemental sheet form a height of between 3.75 inches and 4.25 inches and parallel side edges form a width of between 3.0 inches and 3.75 inches. The upper edge is parallel with and spaced beneath the zipper. The lower edge overlies the lower edge of the front sheet beneath the binding. The stitching of the binding joins the supplemental sheet to the front sheet at their lower edges. Supplemental stitching 136 is provided between the upper and lower edges of the supplemental sheet thereby forming a secondary pouch for the removable retention of a cell phone.

Further provided in this embodiment is an elastic band 140. The elastic band is coupled to the upper edge of the supplemental sheet. The elastic band is of a length when not stretched less than the length of the upper edge of the supplemental sheet. In this manner shirring of the upper edge of the supplemental sheet is caused for facilitating the retention of a cell phone within the secondary pouch.

Lastly, in this embodiment all of the sheets are fabricated of an inelastic material. Indicia 144 is provided on the exterior surface of the front sheet and supplemental sheet.

A final alternate embodiment of the object holder system 200 of the present invention is illustrated in FIGS. 8 and 9. In this embodiment, the upper edge 204 of the rear sheet 206 includes a belt 208. The belt has a buckle 210. The belt is removably positioned around the waist of a user. Stitching 212 attaches the rear sheet to the belt. In this final embodiment, all of the sheets are fabricated of an elastic material with the exterior surface of the rear sheet and the front sheet and the supplemental sheet being unadorned.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An object holding and carrying system for removably retaining a wallet, keys and other objects in a primary pouch and a cell phone in a secondary pouch for ready use by a user in a safe, convenient, economical and attractive manner comprising, in combination:

a housing assembly being constructed of a front sheet and a rear sheet, the rear sheet having interior and exterior surfaces, the rear sheet having a horizontal linear upper edge and a convex lower edge separated by a maximum height of between 7.5 inches and 8.5 inches, the rear sheet having curved first and second side edges separated by a maximum width below of between 7.25 inches and 8.0 inches and a minimum width above of between 5.25 inches and 6.25 inches, the rear sheet having an upper section with opposing concave side edges and a lower section with opposing convex side edges;

the front sheet having interior and exterior surfaces with the interior surface facing the exterior surface of the rear sheet, the front sheet having a horizontal linear upper edge and a convex lower edge and curved side edges, the lower and side edges of the front sheet overlying the lower and side edges of the rear sheet, the upper edge of the front sheet being parallel with and spaced below the upper edge of the rear sheet by between 1.5 and 2.5 inches, an upper opening formed in the front sheet, the upper opening being located beneath the upper edge of the rear sheet to define a primary pouch for the retrievable storage of a wallet and keys and other like personal objects;

a zipper extending across the front sheet parallel with and in close proximity to its upper edge for opening and closing access to the primary pouch;

a binding with stitching extending from one end of the upper edge of the rear sheet along the first side-edge and the lower edge and the second side edge and terminating at another end of the upper edge of the rear panel to couple the front and rear sheets;

a rear sheet extension adjacent to the upper edge of the rear sheet, the extension being formed by the rear sheet adjacent to its upper edge being folded back and attached to the interior surface of the rear sheet for the receipt of a belt to couple the system to a user;

a supplemental sheet having interior and exterior surfaces with the interior surface facing the exterior surface of the front sheet, the supplemental sheet being in a generally rectangular configuration with parallel upper and lower edges forming a height of between 3.75 inches and 4.25 inches and parallel side edges forming a width of between 3.0 inches and 3.75 inches, the upper edge being parallel with and spaced beneath the zipper, the lower edge of the supplemental sheet overlying the lower edge of the front sheet beneath the binding with the stitching of the binding joining the supplemental sheet to the front sheet at their loser edges, supplemental stitching between the upper and lower edges of the supplemental sheet, the front sheet and the upper edge of the supplemental sheet forming a lower opening, the upper edge of the supplemental sheet and the lower opening being located beneath the upper edge of the front sheet and the upper opening to thereby form a secondary pouch smaller than the primary pouch for the removable retention of a cell phone;

an elastic band coupled to the upper edge of the supplemental sheet, the elastic band being of a length when not stretched less than the length of the upper edge of the supplemental sheet to thereby cause a shirring of the upper edge of the supplemental sheet for facilitating the retention of a cell phone within the secondary pouch; and all of the sheets being fabricated of an inelastic material with indicia on the exterior surface of the front sheet and supplemental sheet.

* * * * *